United States Patent [19]

Eigenmann

[11] 4,279,534

[45] Jul. 21, 1981

[54] METHOD AND APPARATUS FOR APPLYING HORIZONTAL ROAD MARKING MATERIAL OF HIGH OPTICAL EFFICIENCY

[75] Inventor: Ludwig Eigenmann, Vacallo, Switzerland

[73] Assignee: Owens-Illinois, Inc., Toledo, Ohio

[21] Appl. No.: 54,236

[22] Filed: Jul. 2, 1979

[30] Foreign Application Priority Data

Jul. 5, 1978 [IT] Italy ..... 25381 A/78

[51] Int. Cl.[3] ..... E01C 23/16

[52] U.S. Cl. ..... 404/72; 404/94; 156/560

[58] Field of Search ..... 404/83, 94, 93, 72, 404/75; 156/560

[56] References Cited

U.S. PATENT DOCUMENTS

| | | | |
|---|---|---|---|
| 994,971 | 6/1911 | Beck | 404/94 X |
| 2,187,879 | 1/1940 | Johnson | 404/72 |
| 3,086,431 | 4/1963 | Perry | 404/94 |
| 3,418,896 | 12/1968 | Rideout | 404/14 |
| 3,590,701 | 7/1971 | Broeck | 404/94 X |
| 4,069,281 | 1/1978 | Eigenmann | 404/16 X |
| 4,136,991 | 1/1979 | Clark | 404/94 X |

*Primary Examiner*—Nile C. Byers, Jr.

*Attorney, Agent, or Firm*—H. G. Bruss; Myron E. Click; David H. Wilson

[57] ABSTRACT

Method and device for orienting asymmetrical retro-reflective elements while spreading horizontal road marking material and for applying the oriented asymmetrical retro-reflective elements to the anchoring road marking surface.

8 Claims, 10 Drawing Figures

METHOD AND APPARATUS FOR APPLYING HORIZONTAL ROAD MARKING MATERIAL OF HIGH OPTICAL EFFICIENCY

FIELD OF THE INVENTION

This invention is concerned with methods and devices for the formation, by the use of asymmetrical retro-reflective elements, of traffic regulating markings which are provided with retro-reflection properties. Said retro-reflective elements concerned with the invention are secured to the road pavement by means of a carrying layer which can be a traffic paint film or a resinous layer of a prefabricated tape material and so on.

Asymmetrical retro-reflecting elements are described in the applicant U.S. Pat. No. 4,072,403 but practically when proper optical effects are reached no limitation exists about the selection of the geometry. Of course the form of the retro-reflective element bottom has to be rather flat if the best impact resistance to the traffic abuse has to be achieved.

The asymmetrical elements, having each an upper dome-shaped portion and a flatter bottom portion, require orientation prior to be applied to the sign forming element receptive and anchoring surface layer for having said flatter portion downturned on said surface. If such elements are supplied at random, such orientation is essential, and the contemporary formation of the said element receptive and anchoring surface is also essential.

OBJECTS AND SUMMARY OF THE INVENTION

It is therefore the object of the present invention to provide an advantageous method for forming surface marking on roadable areas with high retro-reflection effect. The new method comprises steps including the spraying of the road marking material, the progressing of plurality of asymmetrical retro-reflective elements on an element carrying surface, the causing of the orientation of these elements during the motion, the applying of the properly oriented elements to this spread and marking layer.

This orientation is preferably reached by positioning proper obstacles to the elements, obstacles which are acting selectivitly with reference to the form of the element impinged surface.

These and other features of the invention will be made best apparent from the following detailed description of the preferred embodiments of same invention, references being made to the accompanying drawings.

THE VIEW OF THE DRAWINGS

DETAILED DESCRIPTION OF THE PREFERRED EMBODIMENTS

Figure 1:
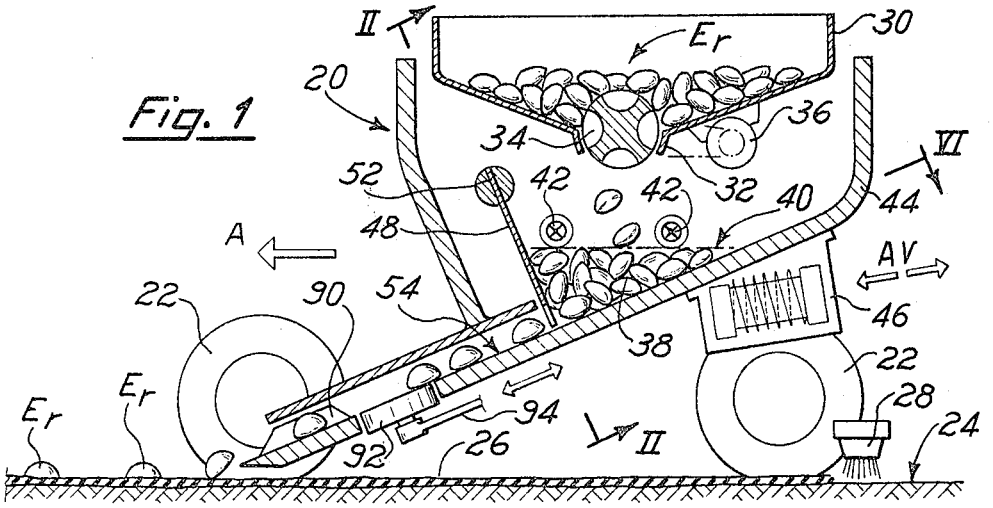
FIG. 1 is a diagrammatical sectional view of a device for orienting the elements.
Figure 3:
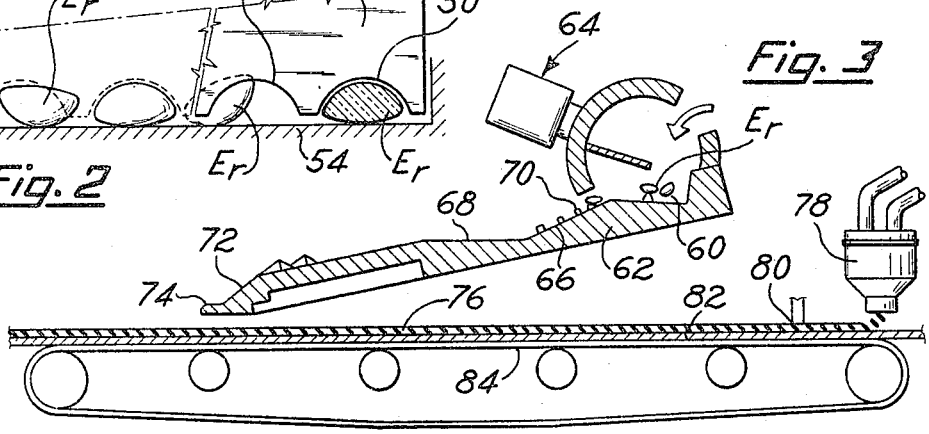
FIG. 3 is a longitudinal sectional view of a modified device.

As shown in FIGS. 1 and 3, a device generally indicated at 20 is secured to a suitable vehicle or has wheels 22 for movement in direction A on a road surface 24 where a known dispenser 28 forms a sign 26, of a suitable element receptive and retentive paint. The details of the paint and of the dispenser and their mode of operating are known and will therefore be omitted. A supply of retro-reflective elements Er, namely asymmetrical elements, is provided by a hopper 30 having an outlet 32 provided with a rotary meter 34 actuated by a motor. The metered elements are collected into a vessel 38 at a level 40 sensed by a sensor 42 with photoelectric cells and controlling motor.

Figure 2:
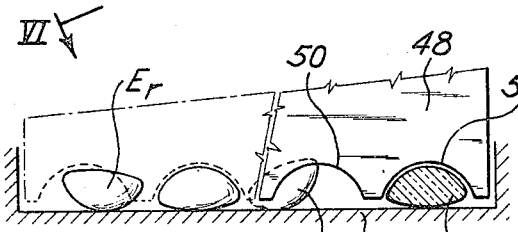
FIG. 2 is an enlarged fragmentary view of a detail taken in the plane indicated at II—II in FIG. 1.

The vessel 38 is secured to or integral with a structure 44 associated with a conventional vibrator 46 which causes the structure to vibrate in direction AV to urge the randomly collected elements against a gate 48 apertured at 50 (FIG. 2) and vibratorily supported at 52. The apertures 50 are so shaped and oriented that properly oriented elements only can pass through. In FIG. 2 some not properly oriented elements Er are shown as being not indexed with the apertures. The elements admitted to pass over slide down along an inclined plane 54 until they properly fall on the element retentive layer 26 for being anchored thereto in proper orientation.

Figure 4:
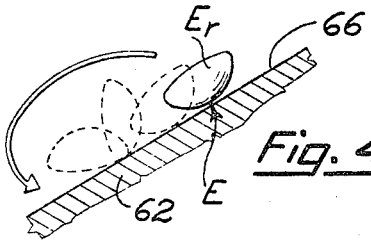
FIGS. 4 and 5 are details of the orientation steps.
Figure 5:
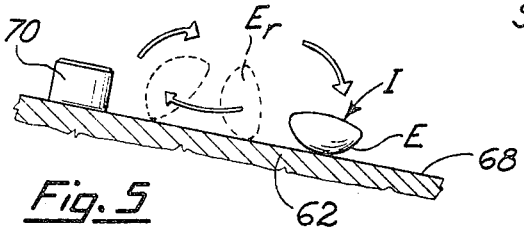

In the modified embodiment of FIG. 3 the elements are supplied at random into a vessel 60 formed integrally with a structure 62 connected to a vibrator 64. The structure has an upper surface having a number of variously inclined portions 66 and 68 and obstacle forming protrusions 70. During sliding downhill along the most inclined portions 66 (FIG. 4) the elements Er slide on their dome-shaped portions E, the rolling motion tending to stabilize on the flatter portions I. The multiple rebounds against obstacles expedite the orientation. A short step 74 promotes the applying of the oriented elements on the receptive layer which, in the modified embodiment of FIG. 3, is a layer 76 formed from a dispenser 78 and doctored at 80 on a tape 82 conveyed at 84 for forming prefabricated tape material.

Figure 6:
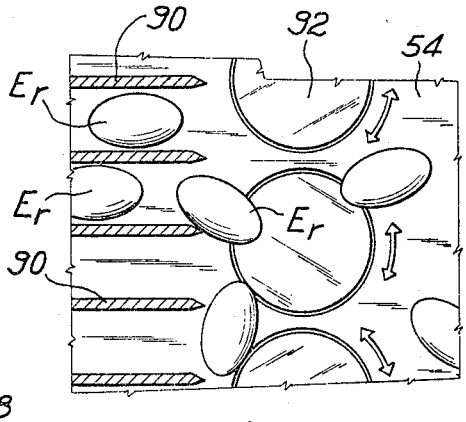
FIG. 6 is a detail taken in the plane indicated at VI—VI in FIG. 1 illustrating means for either zenithal and azimuthal orientation.

By means of the device of FIG. 6, zenithally oriented elements Er are azimuthally oriented also, by being caused to fit between guide passages 90 (see also FIG. 1) by alternatively rotating small disks 92 in flush with the surface 54 with a leverage 94 promoting the rotation.

Figure 7:
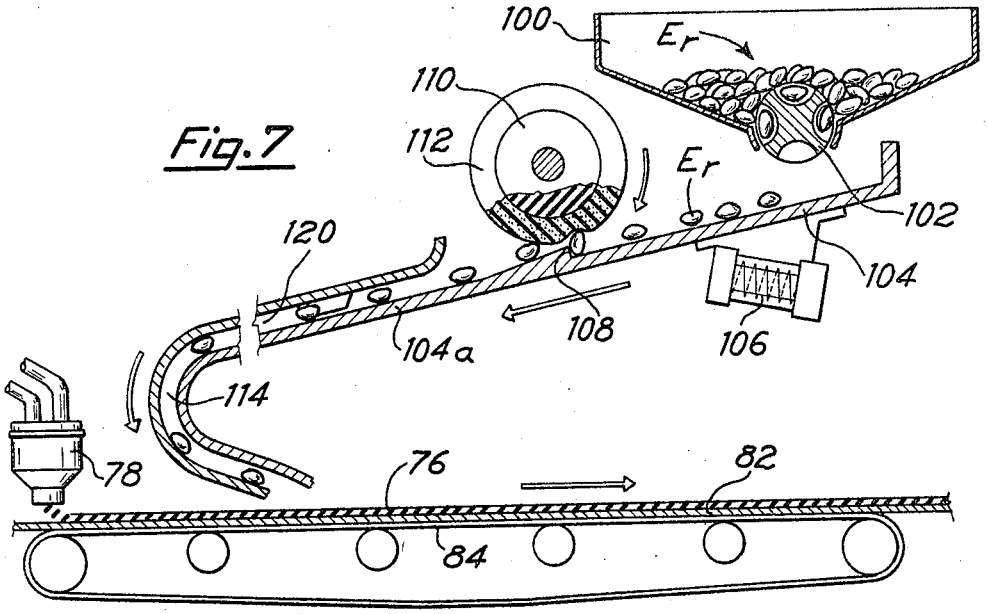
FIG. 7 is a vertical sectional view of a further modified device for zenithal and azimuthal orientation of randomly supplied elements.
Figure 8:
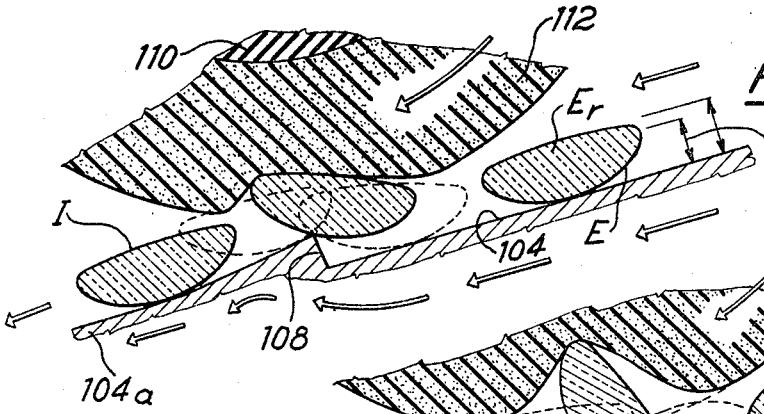
FIGS. 8 and 9 illustrate in larger scale and detail the vertical or zenithal orientation step in the device of FIG. 7.
Figure 9:
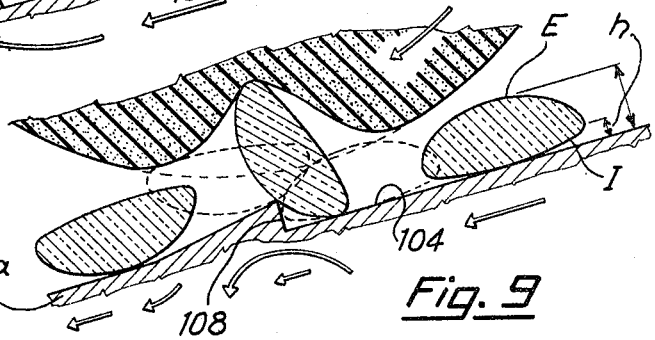

A preferred embodiment of the zenithally orienting device is shown in FIGS. 7 to 9 elemennts Er are supplied at random into a hopper 100 and transferred by a rotary valve 102 on a carrying surface 104 formed in a structure secured to a vibrator 106. The surface is inclined to facilitate the movement in the direction indicated by the upper arrow in FIG. 7.

Figure 10:
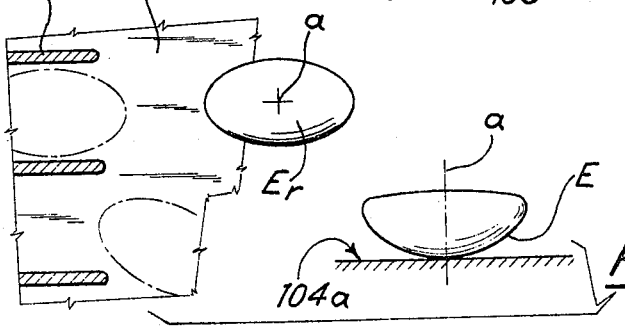
FIG. 10 diagrammatically illustrates the azimuthal orientation occuring after the zenithal one, so that the element can easily rotate on its most convex face.

The surface 104 has a step 108 of height smaller than the convexity H (FIG. 8) of the dome-shaped portion E of each element, but greater than the shallower convexity h (FIG. 9) of the opposite portion of the element. The elements are compelled to sequentially pass over the step 108 as being urged in the direction indicated by arrows by a roller 110 having a very soft and resilient periphery 112 of sponge rubber for example. If one element contacts the step with its more convex surface E (FIG. 8) it can slide thereover without modification of its zenithal orientation. On the contrary, another element approaches the step by sliding on the surface 104 or 104*a* (FIG. 10) with its flatter surface portion I (FIG. 9) and is caused to abut against the step 108 and to overturn for passing thereover. All elements which have anyhow passed the step will remain evenly oriented as shown in FIGS. 8 and 9.

Of course such orientation is the reverse to that necessary for applying the elements at their flatter face on the element retentive sign forming layer. On the other hand, such temporary orientation facilitates when the elements need a further orientation the azimuthal orientation about the minor axis a (FIG. 10) passing between parallel guide rails 120 located where shown in FIG. 7, upstream of a curved guide path 114.

The elements are successively applied to an element receptive layer 76, similar to that of the embodiment of FIG. 3.

The embodiment of FIG. 7 is very suitable for the orientation of retro-reflective elements in the pre-alignment rows method for forming road marking of very high optical efficiency.

I claim:

1. A method of producing on a road surface area a retro-reflective traffic regulating sign including a plurality of asymmetrical retro-reflective elements having a dome-shaped upper portion adapted for light impingement and retro-reflection and a substantially flat lower portion; the method comprising the steps of applying a road marking receptive layer to a road; advancing a plurality of randomly positioned asymmetrical retro-reflective elements along an element supporting surface; orienting said elements during the advancing movement thereof on said surface so that some of said elements are turned over whereby all the elements abut against said surface by the same one of said portions after said orienting step; and applying said properly oriented elements to said receptive layer, said orienting step being performed simultaneously with said step of applying the road marking receptive layer to thereby form a retro-reflective sign-forming composition on the road.

2. The method of claim 1, wherein the said supporting surface is subjected to a vibratory motion.

3. The method of claim 2, wherein the said supporting surface has subsequent portions having differing inclinations relatively to horizontal, the greatest inclination being such as to cause element resting on the inclined portion of said surface with its dome-shaped portion to oscillate and have its flat portion downturned.

4. The method of claim 2, wherein said orienting step is obtained by positioning on said supporting surface at least one obstacle.

5. The method of claim 4, wherein said obstacle is an elevated step formed on said supporting surface, said step having a height corresponding to the height of said substantially flat portion of said element and wherein said advancing elements being urged toward said step by a rotary resilient roller to thereby provide a desired orientation.

6. The method of claim 4, wherein said orienting step is obtained by positioning on said supporting surface a plurality of obstacles located to form passages therebetween, said passages being shaped and dimensioned so as to properly orient and pass through said elements.

7. The method of claim 1, wherein said road marking receptive layer is formed by applying of a sign forming paint.

8. An apparatus for forming on a road surface area a retro-reflective traffic regulating sign adapted to move on said area in the direction of the sign being formed, comprising means for applying a road marking receptive layer to a road; means for supplying a randomly positioned asymmetrical retro-reflective elements; an element supporting surface adapted to receive said elements from said supply means and advance them toward the road; orientation means adapted to provide an obstacle for said advancing elements and turn over some of said elements to thereby orient all of said elements in one predetermined order; and means for applying the properly oriented elements to said road-marking receptive layer simultaneously with applying said layer to the road to thereby form a retro-reflective sign forming-composition on the road.

* * * * *

UNITED STATES PATENT AND TRADEMARK OFFICE

CERTIFICATE OF CORRECTION

PATENT NO. : 4,279,534

DATED : July 21, 1981

INVENTOR(S) : Ludwig Eigenmann

It is certified that error appears in the above-identified patent and that said Letters Patent are hereby corrected as shown below:

On The Title Page:

In the heading [73], cancel "Owens-Illinois, Inc., Toledo, Ohio".

Directly above the Abstract, [57], cancel "H. G. Bruss; Myron E. Click; David H. Wilson" and substitute -- Michael J. Striker --.

Signed and Sealed this

Tenth Day of November 1981

[SEAL]

Attest:

GERALD J. MOSSINGHOFF

Attesting Officer

Commissioner of Patents and Trademarks